US005701759A

United States Patent [19]

Boehme

[11] Patent Number: 5,701,759

[45] Date of Patent: Dec. 30, 1997

[54] ACCUMULATOR HAVING A HEAT INSULATING COVER

[75] Inventor: Dietmar Boehme, Duisburg, Germany

[73] Assignee: Ford Global Technologies, Inc., Dearborn, Mich.

[21] Appl. No.: 755,530

[22] Filed: Nov. 21, 1996

[30] Foreign Application Priority Data

Nov. 22, 1995 [DE] Germany ..... 195 43 463.3

[51] Int. Cl.[6] ..... F25B 43/00

[52] U.S. Cl. ..... 62/503; 220/412; 248/188

[58] Field of Search ..... 62/503; 220/412, 220/445; 248/188

[56] References Cited

U.S. PATENT DOCUMENTS

| | | | |
|---|---|---|---|
| 3,144,160 | 8/1964 | Johnson et al. | 220/412 |
| 3,765,192 | 10/1973 | Root | 62/503 |
| 3,865,050 | 2/1975 | Cecchetti | 248/188 |
| 4,071,160 | 1/1978 | Vick | 220/412 |
| 4,187,695 | 2/1980 | Schumacher | 62/503 |
| 4,746,017 | 5/1988 | Howard et al. | 220/445 |
| 4,831,843 | 5/1989 | Cochran | 62/503 |
| 5,251,542 | 10/1993 | Itoh et al. | 220/412 |
| 5,597,086 | 1/1997 | King-Shui | 220/412 |
| 5,597,145 | 1/1997 | Meyers et al. | 248/188 |

FOREIGN PATENT DOCUMENTS 3518305 11/1985 Germany .

*Primary Examiner*—William E. Tapolcai
*Attorney, Agent, or Firm*—Raymond L. Coppiellie

[57] ABSTRACT

An accumulator assembly having an accumulator surrounded by a heat insulating layer on the outer side thereof. The container includes mounting devices formed on the exterior thereof for mounting the accumulator assembly in place.

2 Claims, 2 Drawing Sheets

ACCUMULATOR HAVING A HEAT INSULATING COVER

BACKGROUND OF THE INVENTION

1. Field of the Invention

The present invention relates to an accumulator assembly having an accumulator disposed in a heat insulating container particularly for air conditioning units of motor vehicles.

2. Disclosure Information

Refrigerant collectors, such as accumulator assemblies used in air conditioning systems are known, for example, from German Offenlegungsschrift 35 18 305, and are utilized to prevent the refrigerant from getting into the compressor while still liquid. An accumulator vaporizes the collected liquid refrigerant as effectively as possible prior to the refrigerant flowing to the compressor. Usually the refrigerant collectors are in the form of separate components. In the case of a motor vehicle air conditioning system, the accumulator assembly is screwed on to a fixing point on the bodywork, for example with a clip or strap which embraces the accumulator assembly and is provided with a bracket. If the amount of refrigerant collected in the accumulator assembly is too great, i.e., if the vaporization of the liquid refrigerant is not effective enough, the performance of the air conditioning unit may degrade. It is therefore necessary to ensure adequate vaporization of refrigerant in the accumulator assembly.

It is an object of the present invention to improve an accumulator assembly of the kind referred to above so that adequate vaporization occurs.

SUMMARY OF THE INVENTION

To this end, the present invention provides an accumulator assembly for an air conditioning system of an automotive vehicle, comprising an accumulator for receiving refrigerant therein and a heat insulating container surrounding the accumulator. The heat insulating container includes a generally cylindrical top member having a top surface and a generally cylindrical wall projecting therefrom, the wall having an interior surface and an exterior surface. The top member further includes a plurality of rib members extending vertically on the interior surface thereof, the top member rib members being tapered at one end thereof.

The heat insulating container further included a generally cylindrical lower member having a base member with a condensate relieving aperture formed therein, the lower member further having a generally cylindrical wall projecting vertically from the base member to an open end which defines an accumulator receiving volume thereby. The wall has an interior surface and an exterior surface. The lower member also includes a plurality of rib members formed on and extending vertically along the interior surface of the wall. The rib members are tapered at the open end of the lower member such that the distance the ribs extend from the interior surface is less at the open end than at the base member of the lower member. Furthermore, the rib members extend radially across the base member. An air gap is formed by the rib members and interposed between the accumulator and the interior wall of the lower member to create an insulating layer effect.

The heat insulating container also includes a plurality of mounting devices formed on the exterior surface thereof, wherein the accumulator assembly can be mounted to a stationery surface by the mounting devices.

It is an advantage of an accumulator assembly of this kind that undesired excessively high heat absorption is very largely avoided and hence the effectiveness of the vaporization of refrigerant and the overall performance of the accumulator assembly is considerably improved. Surrounding the accumulator by a heat insulating layer greatly reduces heat absorption from the surroundings, so that the liquid refrigerant introduced into the accumulator can vaporize without any further supply of heat which increases the compressor intake temperature. This alone improves the performance of an accumulator accordance with the invention compared with the prior art.

It is a further advantage that an additional increase in performance results from the fact that an accumulator structured in accordance with the present invention is mounted using the heat insulating container. Hence no heat is conducted via the fastening points of the accumulator assembly to the vehicle. Because of the improved performance of an accumulator assembly in accordance with the present invention, the operating costs of the air conditioning system in which it is used can also be lowered.

Other features, objects and advantages of the present invention will become apparent from the detailed description, drawings and claims which follow.

BRIEF DESCRIPTION OF THE DRAWINGS

The invention will now be described in more detail, by way of example, with reference to the drawings, in which.

DETAILED DESCRIPTION OF THE PREFERRED EMBODIMENTS

Figure 1:
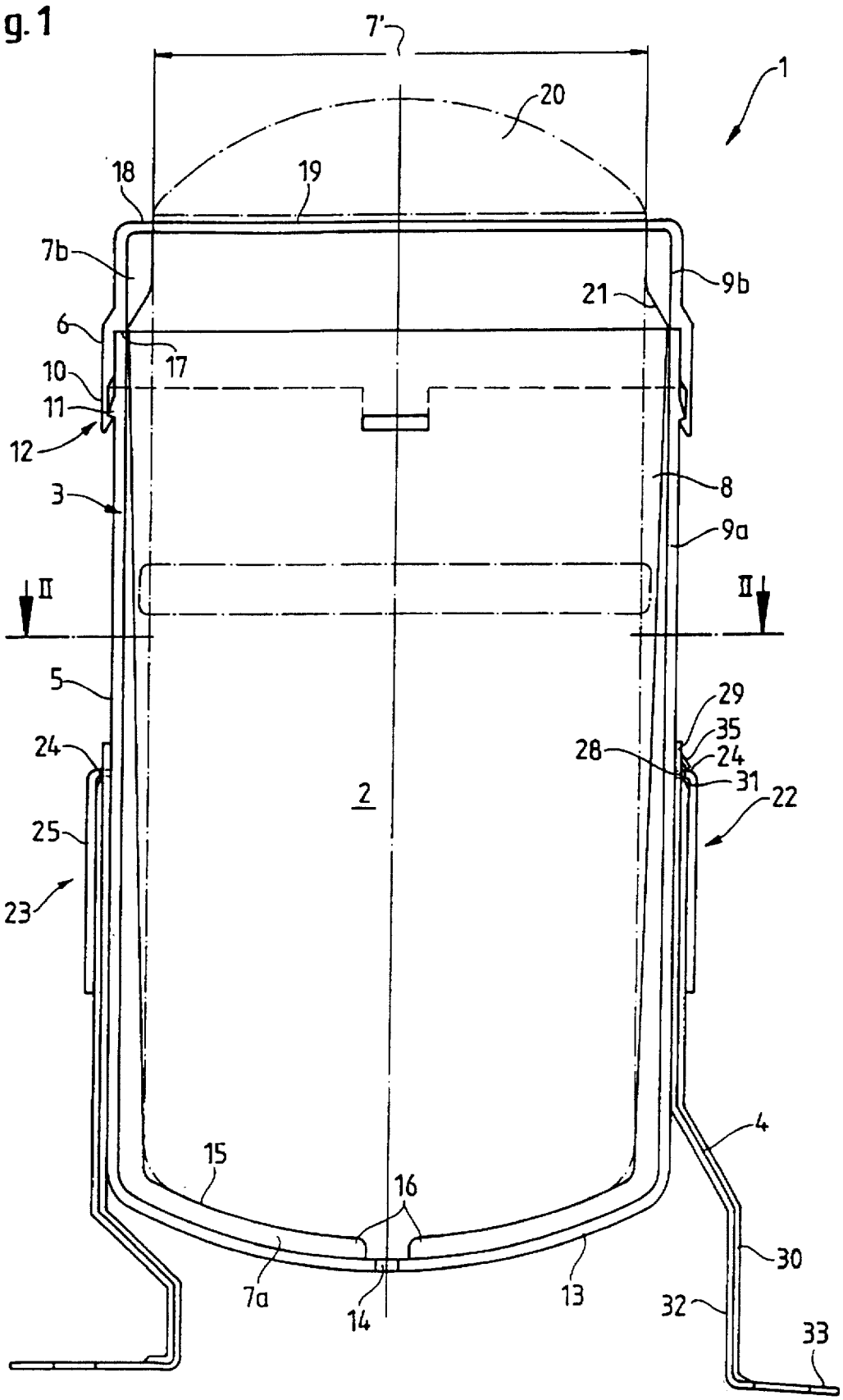
FIG. 1 is a cross sectional view of an accumulator assembly of the present invention along the line I—I in FIG. 2, the outer outline of the accumulator being shown by chain lines.

The accumulator assembly 1 shown in the Figures forms part of an air conditioning system of a motor vehicle. The accumulator assembly 1 includes an accumulator 2 and a heat insulating container 3 which surrounds the accumulator 2 and is held by supports 4 which are screwed to the body shell (not shown) of the vehicle. While being described with use for an accumulator, the principles of the present invention may be utilized with other types of refrigerant collectors.

The heat insulating container 3 is made up of a lower part member 5 and an upper part member 6, both substantially cylindrical in shape. On its inner side, the heat insulating container 3 has ribs 7 both in the lower part 5 and in the upper part 6 which are in contact with the accumulator 2. The space between the ribs 7 forms an air gap 8 between the accumulator 2 and the wall 9 of the heat insulating container 3. The internal diameter of the wall **9*a* of the lower part 5 is the same as the internal diameter of the wall 9*b* of the upper part 6, so that the two walls 9*a*, 9*b* are flush with one another on their inner sides. On the outer side the lower end of the upper part 6 engages over the lower part 5. Several extensions 10 projecting downwardly from the lower end of the upper part 6 and distributed uniformly around its circumference, together with radially projecting protrusions 11 in the upper part of the lower part 5, form snap fastenings 12**.

The lower region of the lower part 5 is closed by a dome-shaped base 13 which is combined integrally with the cylinder wall 9a of the lower part. At the lowest point of the dome-shaped base 13 a small opening 14 is provided as a drain for condensate water. On the inner side of the wall of the lower part 5 ribs 7a are formed which extend radially across the base 13 starting from the condensate water drain opening 14, and in the region of the cylindrical wall 9a extend in the longitudinal direction of the cylinder. The contour of the dome-shaped base 13 and of the ribs 7a formed on the base 13, which have a constant height, matches the contour of the lower end of the accumulator 2, which thus lies throughout on the inner wall 15 of the ribs 7a formed on the base 13. The distance between the radially inner ends 16 of these ribs 7a is greater than the diameter of the condensate water opening 14 (for example, twice as great), so that the condensate water can drain out unhindered, minimizing the risk that condensate water will pool around the base of the accumulator. The ribs 7a formed on the cylinder wall 9a run almost as a pointed cone towards this wall and to the connecting seam 17 with the upper part 6. For example with a lower part 5 that is about 168 mm high and with ribs 7 about 4.5 mm high, this inclination can be 1.5°. The ribs also contribute to strength and stability of the lower member. It is advantageous if the ribs on the cylinder wall taper towards the open end and towards the cylinder wall. When the ends of the ribs in the lower part are shaped in this way, the accumulator can be introduced or inserted into the lower part without any difficulty.

The upper part 6 is formed as a lid and has in its upper end face 18 an opening 19 through which the accumulator 2 projects with its upper, domed end 20. Preferably at least one opening is provided in the upper part 6 through which a portion of the accumulator 2 projects from the heat insulating container. This facilitates the connection of the pipes for the supply and forwarding of the refrigerant. In a preferred embodiment of the invention, the upper part 6 has an upper end face in which this opening is formed. With this embodiment it is possible to guide the upper part 6 from above over the accumulator 2 inserted in the lower part and to connect it to the lower part.

The cylinder wall 9b of the upper part 6 is likewise provided with ribs 7b on its inner side which are aligned with the ribs 7a formed in the lower part 5. The lower ends 21, facing the lower part 5, of the ribs 7b each taper towards the cylinder wall 9b and to the joint 17 with the lower part 5, the tapering ends of the ribs 7a, 7b of the upper and lower parts 6, 5 respectively facing the joint 17 between the upper and lower parts 6, 5. Just as in the case of the ribs in the lower part of the heat insulating container, forming ribs in the upper part 6 makes it possible to form the air gap economically and also increases the load bearing capacity and dimensional stability of the upper part without any substantial increase in weight. The ribs preferably taper towards the lower end and towards the cylinder wall, thereby considerably simplifying putting the upper part on to the accumulator and/or the introduction of the accumulator into the upper part of the heat insulating container.

Figure 2:
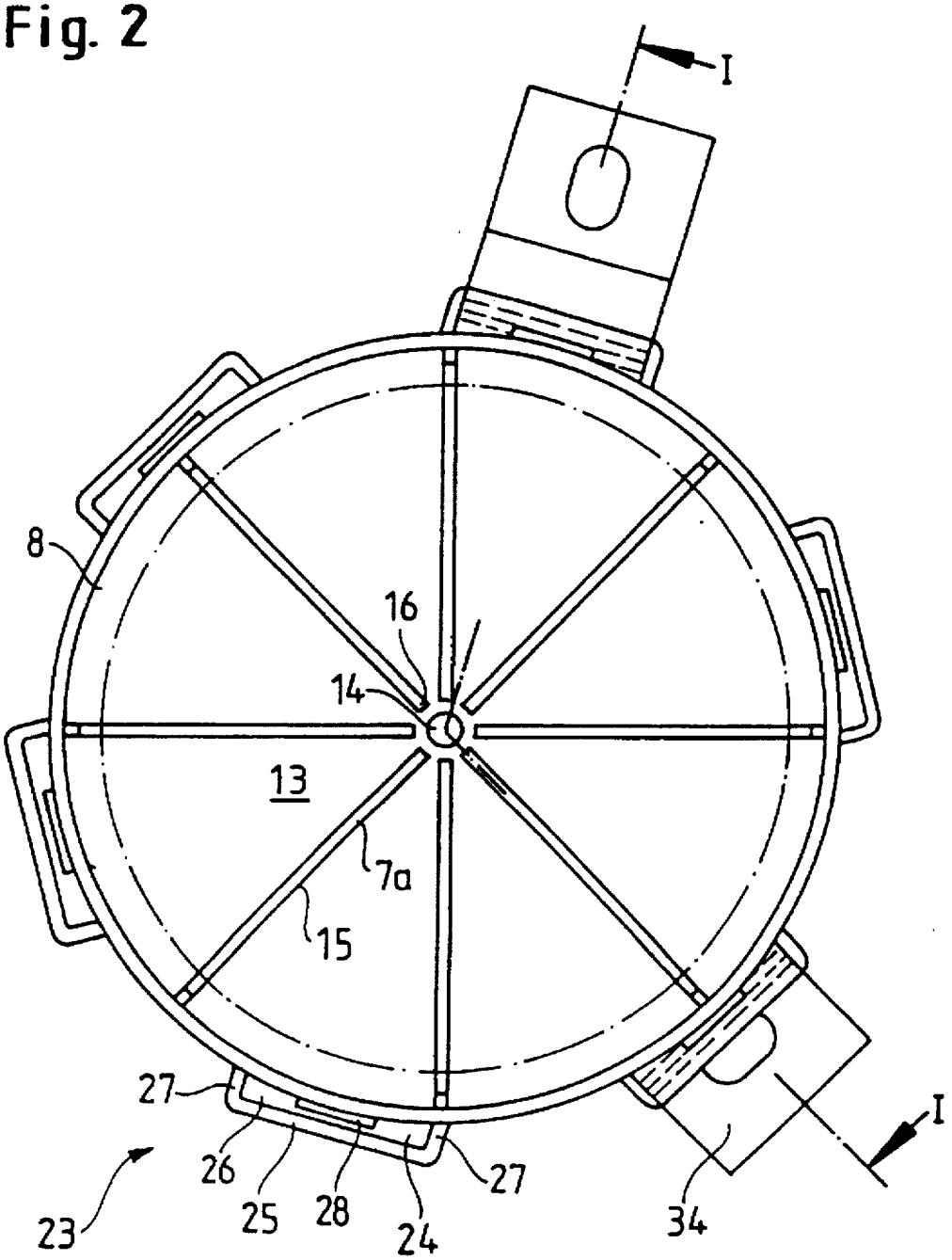
FIG. 2 is a section view taken along the line II—II in FIG. 1.

In each of the upper and lower parts 6, 5 eight ribs 7b are provided, which are uniformly distributed around the circumference and thus are each at an angle of 45° to their neighboring ribs (FIG. 2). In the lower region of the lower part 5 and in the upper part 6 the diameter 7' of the smallest internal circle described by the ribs 7 corresponds to the external diameter of the accumulator 2, so that this vessel is radially supported in this region. This ensures that the accumulator is held securely in the heat insulating container, thereby avoiding any radial movement of the accumulator relative to the heat insulating container and hence any shock loading or even noise.

The lower part 5 has in the lower region of its cylindrical outer wall devices 22 for mounting the accumulator assembly 1. In the present case these devices 22 for mounting the accumulator assembly 1 are in the form of pocket-shaped sockets 23, and in the section shown in FIG. 1 are L-shaped, the short limb 24 of the "L" being connected to the outer wall of the heat insulating container 3 and forming an upper closure wall of the pocket-shaped socket 23. The long limb 25 of the "L" extends downwardly, spaced from and parallel to the outer wall of the heat insulating container 3, and forms a closure wall in the tangential direction (see FIG. 2), whereby a slot 26 is formed between the outer wall and the long limb 25. In the circumferential direction the sockets 23 are closed off by lateral walls 27, which are similarly connected to the cylindrical outer wall of the heat insulating container. In the present case six such pocket-shaped sockets 23 are attached to the heat insulating container 3, uniformly spaced in the circumferential direction, so that one socket 23 is spaced 60° from its neighboring sockets 23. In this way the accumulator assembly can be fitted in different positions, so that, for example, fitting it in different vehicle models is still further simplified.

In the example shown the accumulator assembly is mounted on two supports 4. In this case the supports 4 are each formed as a flat tongue or a flat web which is pushed from below into the slot 26 far enough for the upper end of the support 4 to contact the downwardly facing inner side of the upper closure wall 24 of the pocket-shaped sockets 23, i.e. of the small limb of the "L". In order to ensure that the support 4 is introduced completely into the pocket-shaped socket 23, a small opening 28 is provided in the upper closure wall 24 of the socket 23 through which a portion 29 of the support 4 projects and thus signals that the support 4 has been completely inserted into the socket 23. Further, the portion 29 of the support 4 is so formed that an outwardly protruding catch 35 is supported on the upper closure wall 24 and thus prevents accidental release of the support 4 from the devices 22. The support 4 can have a bead extending in its longitudinal direction stamped in it. It can also be provided that the support 4 is made in two layers, with an outer layer 30, facing away from the heat insulating container, having its inner end 31 in continuous contact with the inner side of the upper closure wall 24 of the socket 23, while an inner layer, facing the heat insulating container 3, includes the small portion or projection 29 which projects through the opening 28 in the upper closure wall 24 of the socket 23 and enables correct seating of the accumulator assembly 1 on the supports 4 to be detected. At the lower or foot end of the support 4 the inner layer 32 projects beyond the outer layer 30, in order to form a foot 33 of the support which serves for screwing the support 4 on to the body shell of the vehicle. When the accumulator assembly is correctly seated on the mountings, a portion of the support must project through the upper opening in the pocket-shaped socket and thus be visible. Accidental release of the accumulator assembly from its mountings is thus very largely avoided.

Other variations and modifications to the present invention will no doubt occur to those skilled in the art. For example, the heat insulating container may be formed from a variety of materials, such as synthetic polymeric materials, in a variety of manufacturing processes. It is the following claims, including equivalents, which define the scope of the invention.

What is claimed is:

1. An accumulator assembly for an air conditioning system of an automotive vehicle, comprising:

accumulator for receiving refrigerant therein; and a heat insulating container surrounding said accumulator, said heat insulating container including:

a generally cylindrical top member having a top surface and a generally cylindrical wall projecting therefrom having an interior surface and an exterior surface, said top member including a plurality of rib members extending vertically on the interior surface thereof, said top member rib members being tapered at one end thereof;

a generally cylindrical lower member having a base member with a condensate relieving aperture formed thereinto, said lower member further having a generally cylindrical wall projecting vertically from said base member to an open end which defines an accumulator receiving volume thereby, said wall having an interior surface and an exterior surface, said top member being matingly engageable with said lower member, said lower member including:

a plurality of rib members being formed on and extending vertically along the interior surface of said wall, said rib members being tapered at the open end, said rib members further extending radially across said base member;

a plurality of mounting devices formed on the exterior surface thereof, wherein said accumulator assembly can be mounted to a stationery surface by said mounting devices, each of said mounting devices including a pocket-shaped socket, the pocket-shaped socket including a short arm portion extending horizontally away from the exterior surface of said lower member and a long arm portion extending vertically from said short arm portion so as to define a receiving space thereby for receiving a mounting stud therein, said short arm portion including an opening for receiving a portion of said mounting stud therethrough; and an air gap formed by said rib members and interposed between said accumulator and said interior wall of said lower member.

2. An accumulator assembly according to claim 1, wherein said mounting device includes a catch for securing said mounting stud thereinto.

* * * * *